US011753919B2

(12) United States Patent
Velikanov et al.

(10) Patent No.: US 11,753,919 B2
(45) Date of Patent: Sep. 12, 2023

(54) METHOD TO IMPROVE HYDRAULIC FRACTURING IN THE NEAR WELLBORE REGION

(71) Applicant: Schlumberger Technology Corporation, Sugar Land, TX (US)

(72) Inventors: Ivan Vladimirovich Velikanov, Novosibirsk (RU); Denis Viktorovich Bannikov, Novosibirskaya (RU); Fedor Nikolaevich Litvinets, Biysk (RU)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 17/757,500

(22) PCT Filed: Dec. 19, 2019

(86) PCT No.: PCT/RU2019/000980
§ 371 (c)(1),
(2) Date: Jun. 16, 2022

(87) PCT Pub. No.: WO2021/125998
PCT Pub. Date: Jun. 24, 2021

(65) Prior Publication Data

US 2023/0022886 A1 Jan. 26, 2023

(51) Int. Cl.
*E21B 43/267* (2006.01)
*E21B 43/26* (2006.01)
(Continued)

(52) U.S. Cl.
CPC ..... *E21B 43/267* (2013.01); *E21B 2200/20* (2020.05)

(58) Field of Classification Search
CPC ..... E21B 43/26; E21B 47/06; E21B 43/267; E21B 49/00; E21B 2200/20; G01V 1/288;
(Continued)

(56) References Cited

U.S. PATENT DOCUMENTS 5,273,115 A 12/1993 Spafford
5,979,557 A 11/1999 Card et al.
(Continued)

FOREIGN PATENT DOCUMENTS

CA 2685587 A1 * 11/2008 ..... E21B 43/26
RU 2496001 C1 10/2013
(Continued)

OTHER PUBLICATIONS

International Preliminary Report on Patentability of International Patent Application No. PCT/ RU2019/000980 dated Jun. 30, 2022, 6 pages.
(Continued)

*Primary Examiner* — Zakiya W Bates

(57) ABSTRACT

The present disclosure relates to a method for stimulating a subterranean formation that includes performing an initial stimulation in a wellbore positioned within the subterranean formation to place a designed volume of a first proppant in fractures, determining a near wellbore fracture width of the fractures, determining an unpropped fracture length of the fractures based on a rock bending model, determining an unpropped fracture volume based on the unpropped fracture length and near wellbore width of the fractures and performing a second stimulation treatment to place a proppant in fractures in an amount equal to the unpropped fracture volume. This operation allows to restore the conductivity of fracture in the damaged zone.

12 Claims, 5 Drawing Sheets

(51) Int. Cl.
*E21B 47/06* (2012.01)
*E21B 49/00* (2006.01)

(58) Field of Classification Search
CPC ..... G01V 99/005; G01V 2210/1234; G01V 2210/646
See application file for complete search history.

(56) References Cited

U.S. PATENT DOCUMENTS

| | | | |
|---|---|---|---|
| 7,069,994 | B2 | 7/2006 | Cooke, Jr. |
| 7,451,812 | B2 | 11/2008 | Cooper et al. |
| 7,580,796 | B2 | 8/2009 | Soliman et al. |
| 3,043,998 | A1 | 10/2011 | Pope et al. |
| 2015/0129211 | A1 | 5/2015 | Dusseault et al. |
| 2018/0149000 | A1 | 5/2018 | Roussel et al. |

FOREIGN PATENT DOCUMENTS

| | | | |
|---|---|---|---|
| RU | 2622961 | C1 | 6/2017 |
| RU | 2637539 | C1 | 12/2017 |
| WO | 2012074614 | A1 | 6/2012 |
| WO | 2015187973 | A1 | 12/2015 |
| WO | 2016182744 | A1 | 11/2016 |

OTHER PUBLICATIONS

Potapenko et al., "Securing Long-Term Well Productivity of Horizontal Wells Through Optimization of Postfracturing Operations", Socieity of Petroleum Engineers, SPE 187104, Oct. 2017, 23 pages.
Suarez-Rivera et al., "Defining Three Regions of Hydraulic Fracture Connectivity, in Unconventional Reservoirs, Help Designing Completions with Improved Long-Term Productivity", Society of Petroleum Engineers, SPE 166505, Oct. 2013, 14 pages.
Search Report and Written Opinion of International Patent Application No. PCT/RU2019/000980 dated Aug. 27, 2020; 8 pages.

* cited by examiner

METHOD TO IMPROVE HYDRAULIC FRACTURING IN THE NEAR WELLBORE REGION

CROSS-REFERENCE TO RELATED APPLICATION

Not applicable.

FIELD

The present disclosure generally relates to the recovery of hydrocarbon fluids from a subsurface formation. More specifically, the present disclosure relates to systems and methods for initially fracturing and re-stimulating a subsurface formation in order to enhance the flow of hydrocarbon fluids through a rock matrix and towards a wellbore.

BACKGROUND

Hydrocarbon exploration and energy industries employ various systems and operations to accomplish activities including drilling, formation evaluation, stimulation and production. Hydrocarbon production can be improved, especially in more challenging types of formations by using stimulation techniques. One such technique is hydraulic fracturing in which stimulation fluid is injected into a formation to generate or open fractures and release stored hydrocarbons. In the later stages of the fracture treatment, a proppant, for example sand, is added to the stimulation fluid so that when injection stops, the fractures that have been created close upon the proppant to form highly permeable channels (compared to the permeability of the surrounding rock) thereby enhancing the production of hydrocarbons from the wellbore (see FIG. 1A where a fracture 1 having a length $L_f$ and a width $W_f$ is shown filled with proppant, and in particular at the near wellbore region 2 adjacent to the wellbore 3).

Several problems have become associated with such stimulation techniques, especially with regard to the placement of the proppants in the fracture. For example, under placement of proppant (i.e. the fracture is not completely filled with proppant) or over displacement of proppant (i.e. proppant moves away from the near wellbore region to a region deeper in the fracture) can lead to a partial or complete loss of conductivity by inducing a choke or pinch point at the fracture entrance. Additionally, overflushing of proppant away from the wellbore by the displacement fluid at the end of a conventional fracture treatment can be responsible for the lack of proppant in the fracture near the wellbore. Finally, if the pressure following injection is released very rapidly, proppant contained within fracture, especially near the wellbore, can be transported back into the wellbore during production causing the collapse or closure of the fracture and thus leading to a sharp decrease in production (see FIG. 1B where fracture 1 of FIG. 1A now has an unpropped zone 4 at the near wellbore region and therefore the fracture width 5 at the near wellbore region is essentially zero—the pinched zone).

Accordingly, there has been much attention spent to prevent the loss and/or restoring of conductivity of existing fractures at the near wellbore region. For example:

U.S. Pat. No. 5,979,557 discloses a method of using an acidizing treatment and/or re-fracturing treatment to restore near wellbore damaged areas of existing fractures;

U.S. Pat. No. 7,069,994 discloses the placement of a plugging agent in a fracture before the entire predetermined amount of proppant reaches the fracture to minimize over displacement of proppant from the fracture;

U.S. Pat. No. 7,580,796 discloses a method which includes the steps of determining whether there are one or more existing fractures, measuring one or more parameters of the existing fractures, determining fracture conductivity damage to the existing fracture and performing a remediative action based on the conductivity damage;

U.S. Pat. No. 8,043,998 discloses a method of treating existing propped fractures in wellbore with a composition containing a solvent and a non-fluorinated polymeric surfactant to increase the conductivity of the fractures;

WO 2012/074614 discloses a method of injecting a first fluid having a first proppant concentration into a formation to form a propped fracture, reducing the pressure in the propped fracture to allow the fracture to substantially close and injecting a second fluid (a refrac) having a second proppant concentration greater than the first proppant concentration to re-open the fracture;

WO 2016/182744 discloses a method of re-fracturing pre-existing fractures by deploying a tool into a well containing the pre-existing fractures, pumping a stimulation fluid into the well to displace the tool past one or more of the pre-existing fractures, leaking off stimulation fluid to an open fracture passed by the tool, locating the open fracture above the tool and re-fracturing the open fracture; and SPE 187104 (1981) "Securing Long-Term Well Productivity of Horizontal Wells Through Optimization of Postfracturing Operations" by Potapenko et al. describes an integrated engineering and operations workflow for optimizing post-stimulation operations on horizontal wells by controlling the productive fracture system evolution during the post-stimulation period. The approach is based on applying the secure operating envelope (SOE) concept, which provides a set of operating parameters that ensure preservation of the connection between the hydraulic fractures and wellbore.

Nevertheless, there is a continuing need for the development of new and improved systems and methods to restore the connectivity of a fracture system with the wellbore where conductivity of fracture(s) in the near wellbore region has been reduced due to, amongst others, under placement/over displacement of proppant, overflushing and/or proppant flowback when the well is produced.

SUMMARY

The present disclosure provides a method of stimulating formation that includes: designing a first stimulation plan to create a propped fracture in the subterranean formation penetrated by a wellbore; performing the first stimulation above a fracturing pressure to place a designed volume of proppant of the first stimulation into a fracture; closing the propped fracture by decreasing wellbore pressure and measuring wellbore parameters using a pressure sensor and a flowmeter; determining a near wellbore width of the fracture based on data obtained from the measuring of the wellbore parameters and from evaluating performance of the first stimulation; determining an unpropped fracture length of the fracture at a near wellbore region based on a rock bending model; determining an unpropped fracture volume at the near wellbore region based on the near wellbore width of the fracture and the unpropped length of the fracture; and performing a second stimulation configured to place proppant of the second stimulation in the fracture in an amount equal to the unpropped fracture volume.

In still another embodiment, the present disclosure provides a system for stimulating a subterranean formation that generally includes: a stimulation device configured to be disposed in a wellbore in the subterranean formation; one or more sensors including a pressure sensor and a flowmeter positioned at a wellhead of the wellbore; and a processor operatively connected to the stimulation device and the one or more sensors and configured to perform; a) a first stimulation configured to create a propped fracture in the subterranean formation; b) measurement of wellbore parameters by the pressure sensor and the flowmeter; c) an analysis of data obtained from the measurements and a determination of a near wellbore width of the fractures, an unpropped fracture length at a near wellbore region, and an unpropped fracture volume at the near wellbore region; and d) a second stimulation configured to place proppant of the second stimulation in the fractures in an amount equal to the unpropped fracture volume.

DETAILED DESCRIPTION

Figure 1A:
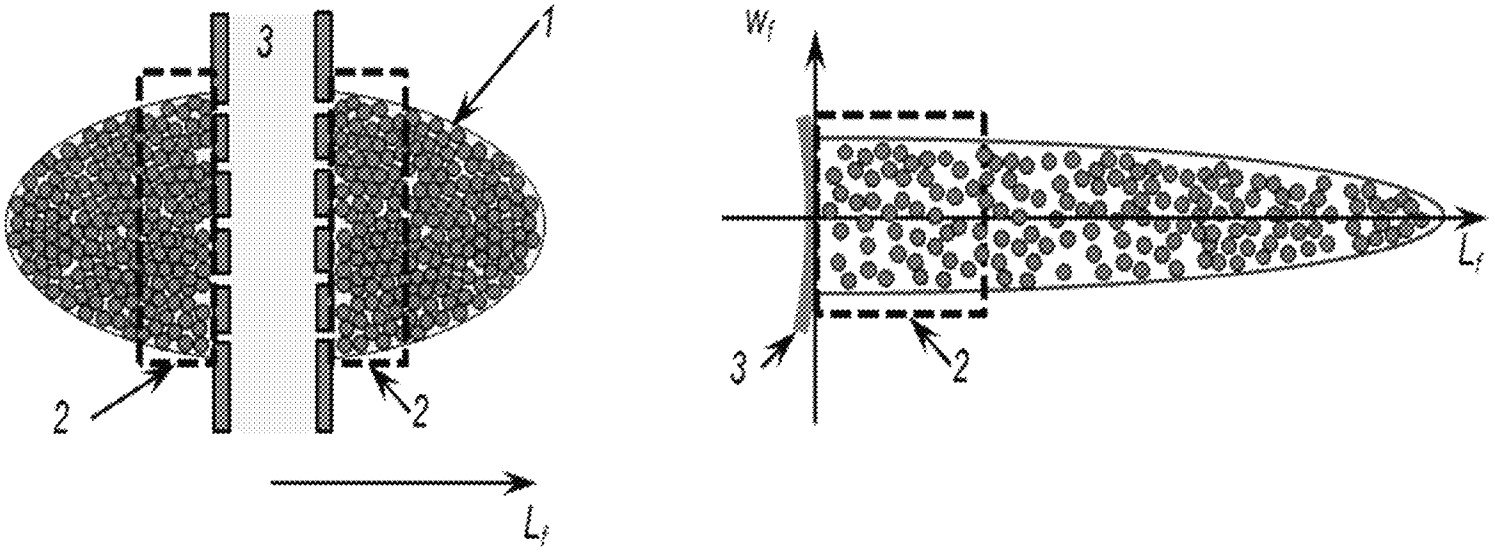
FIG. 1A depicts a propped hydraulic fracture formed during an initial fracturing operation.
Figure 1B:
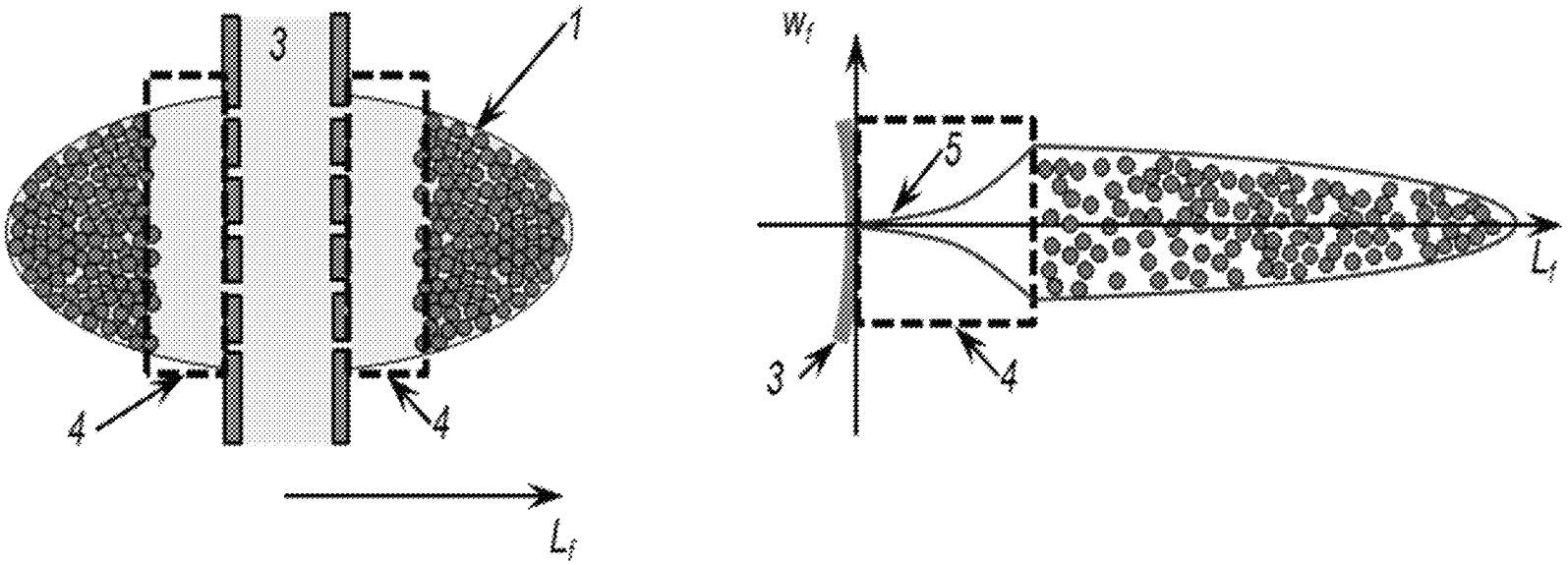
FIG. 1B depicts the propped hydraulic fracture of FIG. 1A which has developed an unpropped zone at the near wellbore region over a period of time after the initial fracturing operation.

The subject matter of the present disclosure is described with specificity; however the description itself is not intended to limit the scope of the disclosure. The subject matter thus, might also be embodied in other ways, to include different structures, steps and/or combinations similar to and/or fewer than those described herein, in conjunction with other present or future technologies. Although the term "step" may be used herein to describe different elements of methods employed, the term should not be interpreted as implying any particular order among or between various steps herein disclosed unless otherwise expressly limited by the description to a particular order. Other features and advantages of the disclosed embodiments will be or will become apparent to one of ordinary skill in the art upon examination of the following figures and detailed description. It is intended that all such additional features and advantages be included within the scope of the disclosed embodiments. Further, the illustrated figures are only exemplary and are not intended to assert or imply any limitation with regard to the environment, architecture, design, or process in which different embodiments may be implemented.

The term "comprising" and derivatives thereof are not intended to exclude the presence of any additional component, step or procedure, whether or not the same is disclosed herein. In contrast, the term, "consisting essentially of" if appearing herein, excludes from the scope of any succeeding recitation any other component, step or procedure, except those that are not essential to operability and the term "consisting of", if used, excludes any component, step or procedure not specifically delineated or listed. The term "or", unless stated otherwise, refers to the listed members individually as well as in any combination.

The articles "a" and "an" are used herein to refer to one or to more than one (i.e. to at least one) of the grammatical objects of the article. The phrases "in one embodiment", "according to one embodiment" and the like generally mean the particular feature, structure, or characteristic following the phrase is included in at least one embodiment of the present disclosure, and may be included in more than one embodiment of the present disclosure. Importantly, such phrases do not necessarily refer to the same aspect. If the specification states a component or feature "may", "can", "could", or "might" be included or have a characteristic, that particular component or feature is not required to be included or have the characteristic.

The term "proppant" refers to particulates and particles suitable for maintaining fractures open. The proppant may be, for example, a lightweight proppant (for e.g. a proppant having a specific gravity less than about 1.5 and/or average diameter of about 0.1-80 microns), a heavy proppant (for e.g a proppant having a specific gravity greater than about 1.5 and an average diameter of about 0.1-80 microns) or a macro proppant (for e.g. a proppant having an average diameter greater than about 100 microns). In addition, the proppant may be a fine-mesh proppant, for example proppant having 40-70, 100 or 200 mesh, or a coarse proppant, for example, proppant having 20-40 or 30-50 mesh. It should be understood that the terms "particulate" and "particle" include all known shapes of materials including substantially spherical materials, fibrous materials, polygonal materials (such as cubic material) and combinations thereof. Proppants envisioned by the present disclosure may include, but are not limited to, conventional proppants familiar to those skilled in the art such as sand, resin-coated sand, sintered bauxite, alumina, minerals, nut shells, gravel, glass beads, polymeric particles, and similar materials coated with various organic resins.

The term "wellbore" denotes a vertical, horizontal or slanted hole drilled in a subterranean formation, such as a rock, to access deeper regions of the subterranean formation in which hydrocarbon fluids such as oil, natural gas or water may be located. The wellbore may be straight, curved, or branched and includes any cased portion, or any uncased or open-hole portion of the wellbore.

The term "near wellbore zone", "near wellbore region" or simply "near-wellbore," refers to an annular volume of the subterranean formation penetrated by the wellbore from the outer diameter of the wellbore extending radially inward along a main fracture from the wellbore and into the formation a distance of no greater than about 10 meters (33 feet).

The present disclosure is generally directed to systems and methods for designing, optimizing and/or performing stimulation operations including fracture and re-fracture treatments of a subterranean formation. Embodiments of methods described herein can generally include designing an initial or first stimulation operation (for e.g. a fracture treatment), performing the fracture treatment on an area of the subterranean formation, closing the fractures by decreasing wellbore pressure and measuring various wellbore parameters using a pressure sensor and flowmeter, determining a near wellbore fracture width $w_f$ for fractures in the treated area based on data obtained from the measurements and from evaluation of the performance of the fracture treatment, calculating portions of fractures that have lost connectivity at their near wellbore regions (i.e. unpropped zone) and therefore have the potential to be re-opened and reconnected to increase overall hydrocarbon production and performing a second stimulation operation (for e.g. a re-stimulation treatment) that targets the unpropped zone. For example, in one embodiment, various wellbore parameters selected from proppant concentration, pressure, pressure derivative, fluid flow rate, fluid flow rate derivative and combinations thereof are measured after the fracture treatment (or during production or flow back) and used to determine an unpropped fracture length $L_{unpropped}$ at the near wellbore region of fractures via a rock bending model.

An unpropped fracture volume for these fractures can be determined based on the near wellbore fracture width $w_f$ and the unpropped fracture length $L_{unpropped}$ and a re-stimulation operation can be subsequently performed to target these fractures by injecting a volume of proppant corresponding to the unpropped fracture volume at a pressure sufficient to reopen and restore their connectivity without disrupting existing proppant outside of the unpropped zone and without intervention into fractures which do not have unpropped zones. In some embodiments, the proppant used in the re-stimulation may be the same proppant as was used during the initial fracture treatment or a different proppant (for e.g. a larger or a stronger (such as ceramic or bauxite instead of sand) or a coarser proppant) to thus enhance stability of the fractures. Accordingly, the methods herein provide new techniques for optimizing and improving overall production from the subterranean formation.

Figure 2:
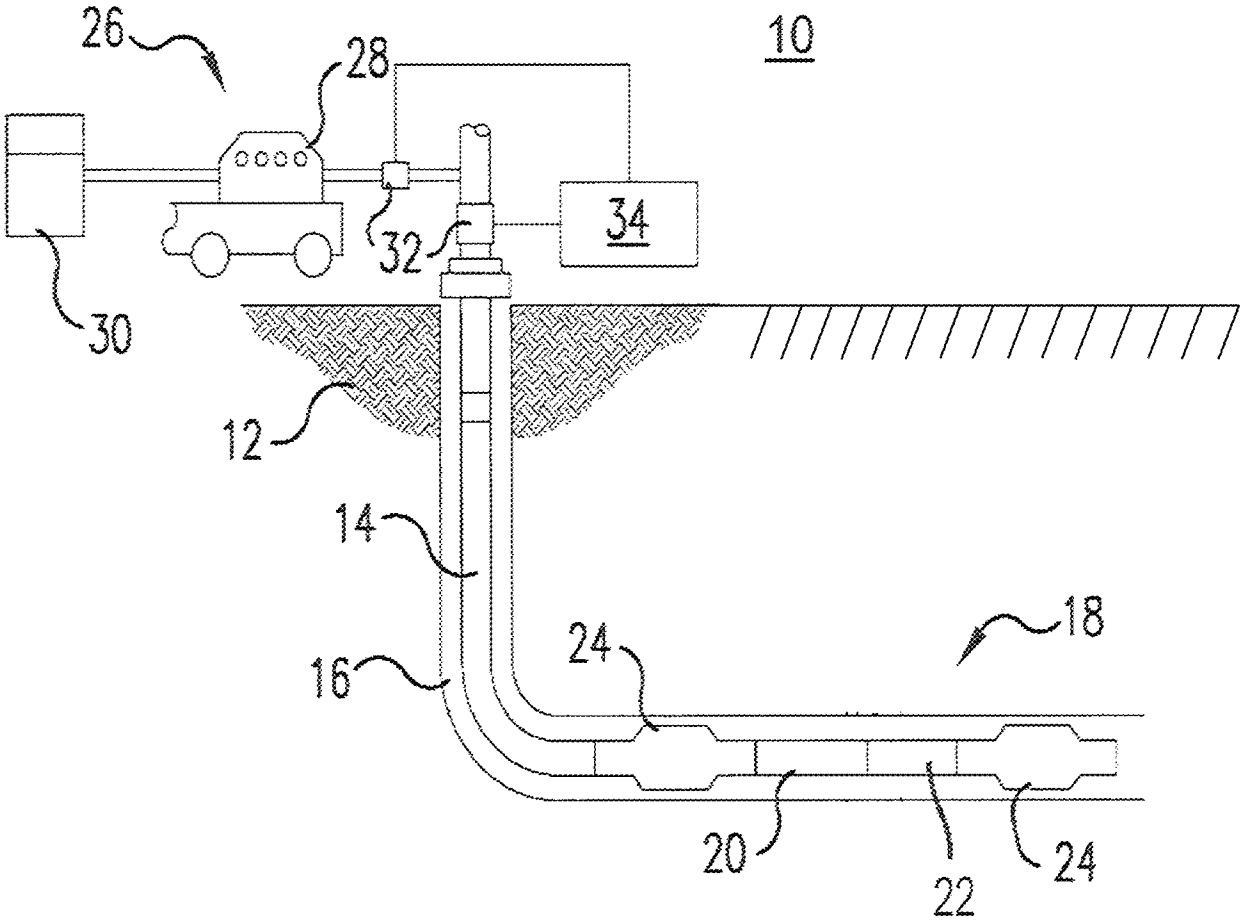
FIG. 2 depicts an elevation view of a hydrocarbon production and/or stimulation system in accordance with an embodiment of the present disclosure.

Referring to FIG. 2, an exemplary embodiment of a hydrocarbon production and/or stimulation system 10 is shown configured to produce and/or stimulate production of hydrocarbon fluids, such as oil, natural gas and/or other fluids, from a subterranean formation 12. For example, the subterranean formation 12 may be a rock formation (for e.g. sandstone) that includes hydrocarbon deposits, such as oil and natural gas. In some cases, the subterranean formation 12 may be a tight gas formation that includes low permeability rock. The subterranean formation 12 may be composed of naturally fractured rock and/or natural rock that is not fractured to any significant degree.

A borehole string 14 is configured to be disposed in a wellbore 16 that penetrates the subterranean formation 12. In one embodiment, the borehole string 14 is a stimulation device (i.e. a stimulation or injection string) that includes a tubular, such as a coiled tubing, pipe (for e.g., multiple pipe segments) or wired pipe, that extends from a wellhead at a surface location. As described herein, "string" refers to any structure or carrier suitable for lowering a tool or other component through the wellbore 16 or connecting a drill bit to the surface, and is not limited to the structure and configuration described herein. The term "carrier" as used herein means any device, device component, combination of devices, media and/or members that may be used to convey, house, support or otherwise facilitate the use of another device, device component, combination of devices, media and/or member. Exemplary non-limiting carriers include casing pipes, wirelines, wireline sondes, slickline sondes, drop shots, downhole subs, bottomhole assemblies and drill strings.

In one embodiment, the system 10 is configured as a hydraulic stimulation system. As described herein, "hydraulic stimulation" includes any injection of a fluid into the subterranean formation 12. A fluid may include any flowable substance such as a liquid or a gas, and/or a flowable solid, such as a proppant.

In this embodiment, the borehole string 14 includes a stimulation assembly 18 that includes one or more tools or components to facilitate stimulation of the subterranean formation 12. For example, the borehole string 14 may include a fracturing assembly 20, such as a fracture or "frac" sleeve device, and/or a perforation assembly 22. Examples of the perforation assembly 22 include shaped charges, torches, projectiles and other devices for perforating the wellbore 16 wall and/or casing. The borehole string 14 may also include additional components, such as one or more isolation or packer subs 24, valves (not shown), sliding sleeves (not shown), actuators (not shown), ports (not shown) and/or other features that communicate fluid from the borehole string 14 into the subterranean formation 12. One or more of the stimulation assembly 18, the fracturing assembly 20, the perforation assembly 22 and/or packer subs 24 may include suitable electronics or processors as further described below configured to communicate with a surface processing unit and/or control unit 34 to operate the respective tool or assembly.

The system 10 thus includes various pieces of equipment configured for injecting fluids into the wellbore in order to, for example, stimulate the subterranean formation 12 to create new fractures and possibly further open natural fractures (referred to as a fracture operation) and/or re-stimulate an area of the subterranean formation 12 that was previously fractured by a fracture operation (referred to as a re-stimulation operation). In one embodiment, the re-stimulation operation, as distinguished from the fracture operation, is performed by injecting fluids comprising proppants into a previously fractured formation in an amount sufficient to eliminate unpropped zones of fractures at their near wellbore regions to thereby restore conductivity and connectivity of these fractures with the wellbore 16 without the intervention into fractures that do not include such unpropped zones in the previously fractured formation.

In one embodiment, an injection system 26 is employed to perform a stimulation operation, for example a fracture operation or re-stimulation operation, by injecting a fluid into the subterranean formation 12 through the wellbore 16. Thus, in some embodiments, the stimulation may stimulate part of a rock formation or other materials in the subterranean formation 12 to create fractures or it may re-stimulate existing fractures of the subterranean formation 12. The injection system 26 may perform stimulation operations that may include single-stage injections, multi-stage injections, mini-fracture tests, follow-on fracture injections, re-fracture injections, final fracture injections, other types of fracture injections, or any suitable combination of injections. The stimulation operation may be a multi-stage injection where individual injections are performed during each stage. A stimulation operation may be applied at a single injection location or at multiple injection locations in the subterranean formation 12, and fluid may be injected over a single time period or multiple different time periods. A stimulation operation may use multiple fluid injection locations in a single wellbore, multiple fluid injection locations in multiple different wellbores, or any suitable combination. Moreover, a stimulation operation may inject fluid through any suitable type of wellbore (for e.g. slanted or horizontal wellbores).

The injection system 26 may include an injection device, such as a high pressure pump truck(s) 28, in fluid communication with a fluid tank 30, mixing unit or other fluid source or combination of fluid sources. Although FIG. 2 depicts a single pump truck 28, any suitable number of pump trucks 28 may be used. The pump truck 28 may include mobile vehicles, immobile installations, skids, hoses, tubes, fluid tanks, fluid reservoirs, pumps, valves, mixers, or other types of structures and equipment. The pump truck 28 may supply fluid or other materials for a stimulation operation. The pump truck 28 may contain multiple different fluids or other materials for different stages of a stimulation operation. The pump truck 28 is configured to be fluidly coupled to the stimulation assembly 18 such that fluid can be injected from the pump truck 28 into the borehole string 14 or the wellbore 16 to thereby introduce fluid into the subterranean formation 12 (for e.g. to fracture and/or re-stimulate the subterranean formation 12). The fluid may be injected through any combination of one or more valves of the stimulation assembly 18. Accordingly, the stimulation assembly 18 may include numerous components including, but not limited to, valves, sliding sleeves, actuators, ports and/or other features that communicate fluid from the borehole string 14 into the subterranean formation 12. In one or more embodiments, the valves, sliding sleeves, actuators, ports and/or other features of the stimulation assembly 18 may be configured to control the location, rate, orientation and/or other properties of fluid flow between the wellbore 16 and the subterranean formation 12.

One or more sensors 32, such as flowmeter and/or pressure sensors are disposed in fluid communication with the pump truck 28 and the borehole string 14 for measurement of fluid characteristics relating to downhole operating conditions. The sensors 32 may be positioned at any suitable location, such as proximate to, for example, at the discharge or within the pump truck 28, at or near the wellhead, or at any other location along the borehole string 14 or the wellbore 16.

Other various sensing or measurement devices 32 may also be included in the system 10 in downhole and/or at surface locations. For example, one or more sensors (or sensor assemblies, such as LWD subs) may be configured for formation evaluation measurements relating to the earth formation 12, wellbore 16 and/or fluids. These sensors may include formation evaluation sensors (for e.g. resistivity, dielectric constant, water saturation, porosity, density and permeability), sensors for measuring geophysical parameters (for e.g. acoustic velocity and acoustic travel time) and sensors for measuring particular wellbore and fluid parameters (for e.g. pressure, flow rate, viscosity, density, proppant concentration, clarity, rheology, pH and gas, oil and water content).

Figure 3:
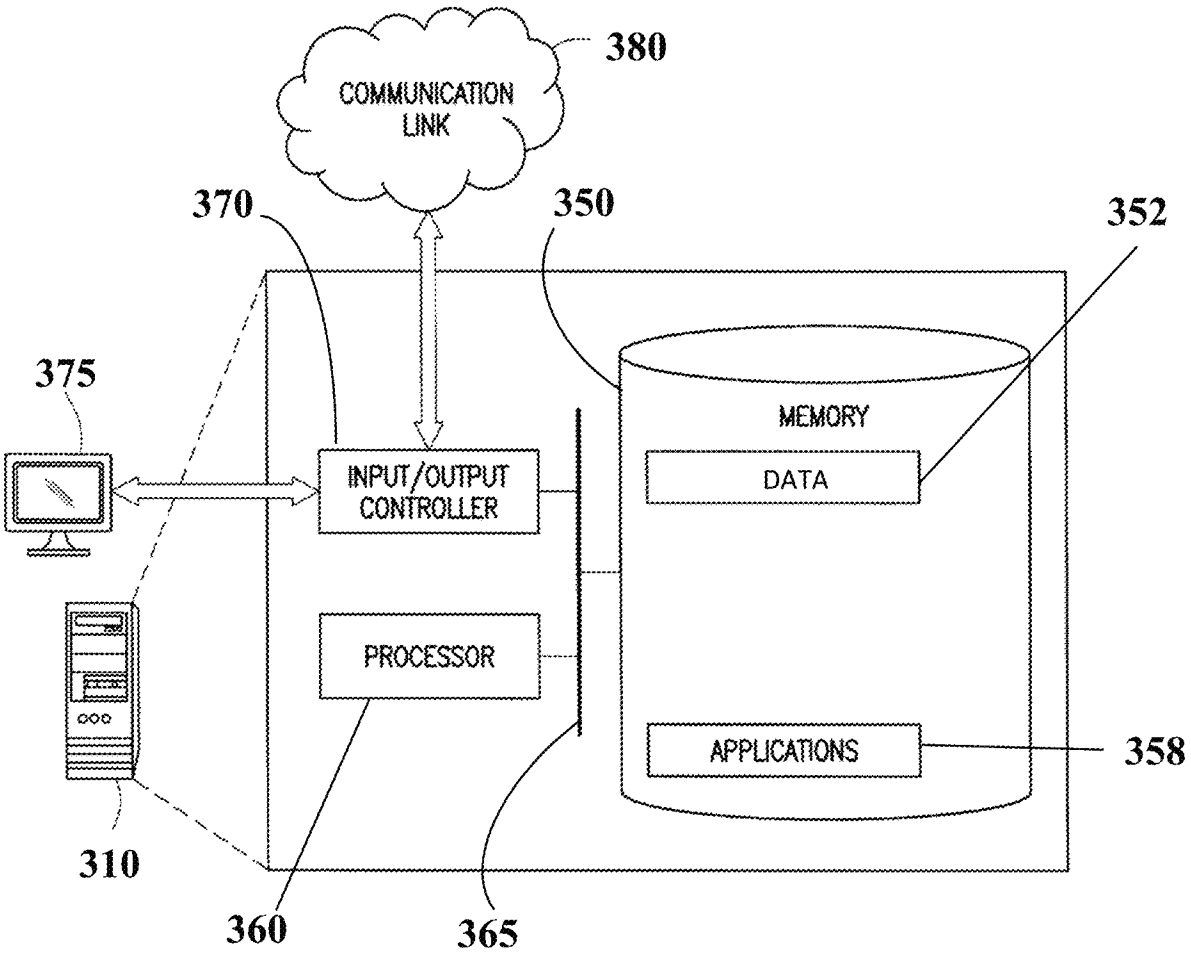
FIG. 3 is a schematic block diagram of a computing subsystem for use in the hydrocarbon production and/or stimulation system of FIG. 2.

The sensors or measurement devices 32 may be used to collect and transmit sensor data, for example, to a computing subsystem 310 (shown in FIG. 3). For example, some sensors 32 may be used above the surface of the earth formation 12 during mechanical testing of one or more samples of rock taken from the subterranean formation 12. Such sensors may include one or more strain gauges, tensile testers or other measuring device used to measure stresses/strains and to determine various parameters of the rock (for e.g. Young's modulus, Poisson's ratio). These measurements may then be analyzed by the computing subsystem 310 and used in designing stimulation operations and for determining the volume of the unpropped zone at the near wellbore region of a fracture as further described below. The sensors 32 described herein are exemplary, as various types of sensors known to those skilled in the art may be used to measure various parameters.

The processing and/or control unit 34 is disposed at the surface of the subterranean formation 12 and is in operable communication with the sensors 32 and the pump truck 28. The processing and/or control unit 34 is configured to receive, store and/or transmit data generated from the sensors 32 and/or the pump truck 28, and may include processing equipment, communication equipment, or other systems that control a treatment. The processing and/or control unit 34 may include or be communicatively coupled to the computing subsystem 310 to calculate, select or optimize stimulation operation parameters for initialization, propagation, opening or re-opening of fractures in the subterranean formation 12. The processing and/or control unit 34 may receive, design, or modify a stimulation operation (for e.g., a proppant placement schedule as described below) that specifies properties and location of an injection to be applied to the subterranean formation 12.

The system 10 may include or access any suitable communication infrastructure. Communication links may allow the processing and/or control unit 34 to communicate with the pump truck 28 or other equipment at the ground surface. Additional communication links may allow the processing and/or control unit 34 to communicate with sensors 32 or a data collection apparatus in the computing subsystem 310, remote systems, other well systems, equipment installed in the wellbore 16, or other devices and equipment. For example, the system 10 may include multiple separate communication links or a network of interconnected communication links. These communication links may include wired or wireless communications systems. For example, the sensors 32 may communicate with the processing and/or control unit 34 or the computing subsystem 310 through wired or wireless links or networks. The processing and/or control unit 34 may also communicate with the computing subsystem 310 through wired or wireless links or networks. These communication links may include a public data network, a private data network, satellite links, dedicated communication channels, telecommunication links, or any suitable combination of these and other communication links.

Referring now to FIG. 3, there is shown an embodiment of the computing subsystem of FIG. 2. The computing subsystem 310 may be located at or near one or more wellbores 16 of the system 10 of FIG. 2 or at a remote location. All or part of the computing subsystem 310 may operate as a component of or independent of the system 10 or independent of any other components shown in FIG. 2. The computing subsystem 310 of FIG. 3 may include memory 350, a processor 360 and input/output controllers 370 communicatively coupled by a bus 365. The memory 350 can include, for example, a random access memory (RAM), a storage device, a hard disk or any other type of storage medium. The computing subsystem 310 may be preprogrammed or it can be programmed (reprogrammed) by loading a program from another source (for e.g. from another computer device through a data network). In some embodiments, the input/output controller 370 is coupled to input/output devices (for e.g. a monitor 375, a mouse, a keyboard, etc.) and to a communication link 380. The input/output devices can receive and transmit data in analog or digital form over communication links, such as a serial link, a wireless link (for e.g. infrared, radio frequency or others), a parallel link or other type of link.

The memory 350 can store instructions associated with an operating system, computer applications and other resources. The memory 350 can also store application data and data objects that may be interpreted by one or more applications or virtual machines running on the computing subsystem 310. As shown in FIG. 3, the example memory includes data 352 and applications 358.

The data 352 may include stimulation operation design data, testing data, geological data, stimulation operation data or any other type of information which may be used to determine the average fracture width $w_f$ and the unpropped fracture length $L_{unpropped}$ at the near wellbore region of fractures and therefore the volume of an unpropped zone for fractures (i.e. unpropped fracture volume) at the near wellbore region.

In some instances, data 352 may include data relating to a stimulation operation design. For example, the stimulation operation design may include a pumping schedule, parameters of a previous stimulation or re-stimulation operation, parameters of a future stimulation or re-stimulation operation or parameters of a proposed stimulation or re-stimulation operation. Such parameters may include information on fluid flow rates, fluid flow volumes, proppant concentrations, fluid compositions, proppant types, stimulation or re-stimulation locations or times, expected production rates and any other parameters.

In some embodiments, data 352 may include real time data relating to a stimulation operation including fluid flow rates, fluid compositions, proppant concentrations, shut-in intervals, pressures, seismic data, combinations thereof or any other data acquired during or after a stimulation or re-stimulation operation. The data 352 can also include any additional data obtained from analyzing the data acquired during or after a stimulation operation. For example, the data 352 may include formation properties such as fracture closure pressure, fracture re-open pressure or any other appropriate data. In some instances the data 352 may include geological data relating to geological properties of the formation 12, such as fluid content, stress profile and pressure profiles which may be obtained from well logs, rock samples, microseismic imaging or other data sources. In some embodiments, the data 352 may include data relating to fractures at an area of the formation 12 which has been stimulated such as identification of the locations, sizes, shapes and other properties of a natural fracture or hydraulically-induced fracture in the formation 12.

The applications 358 can include software applications, scripts, programs, functions, executables or other modules that are interpreted or executed by the processor 360. The applications 358 may include machine-readable instructions for performing one or more treatments and/or for generating a user interface or plot, for example, illustrating wellbore pressure, flow rate or any other information. The applications 358 can obtain input data from the memory 350, from another local source or from one or more remote sources (for e.g. from the communication link 380). The applications 358 can generate output data and store the output data in the memory 350, another local medium or in one or more remote devices. Various software tools are commercially available for the applications 358 either as licensable modules and tools or as part of a well stimulation system, such as those described in U.S. Pat. No. 7,451,812, the contents of which are incorporated herein by reference. For example, the applications 358 may include one or more applications operatively connected such as, but not limited to, a fracture design module for designing an initial fracture or re-stimulation operation, a fracture control module for monitoring, recording and controlling a fracture or re-stimulation operation, a hydraulic fracturing monitoring module for monitoring, recording and reporting real time data during or after a fracture or re-stimulation operation, a fracturing modeling tool and any other appropriate applications.

The fracture design module can design a fracture or re-stimulation operation and the fracture control module can track the fracture or re-stimulation operation and display actual parameters compared to planned parameters from the design. The fracture control module can also control proppant and other additive concentrations via the injection system 26 to ensure actual proppant concentrations and rates follow the design.

The hydraulic fracturing module can receive and interpret data 352 such as data obtained from sensors 32 and/or any other sources during or after the fracture or re-stimulation operation. For example, the hydraulic fracturing module may determine an average fracture width $w_f$ of the fractures based on conductivity estimations (conductivity is proportional to the third power of the fracture width $w_f$) and can report the data to the fracturing modeling tool. Alternatively, the average fracture width $w_f$ may be determined by direct measurement, such as by injecting one or more tracers into the wellbore and measuring their propagation in the fractures.

The fracturing modeling tool can use a hydraulic fracturing simulator to model the fractures, interface with the fracture design module/fracture control module/hydraulic fracturing module to monitor and analyze fracture and re-stimulation operations in real time to determine the unpropped fracture length at the near wellbore region of the fractures using a rock bending model, and from this result and the average fracture width develop a pumping schedule using a pump schedule generator to remedy the unpropped zones of the fractures. For example, the fracturing modeling tool can receive and analyze data 352 including near wellbore fracture width $w_f$ and proppant volume, pressure, pressure derivative, fluid flow rate, fluid flow rate derivative or any combination thereof (for e.g. after closure and pressure has declined below fracturing pressure) in real-time to calculate an unpropped fracture length at the near wellbore region of fractures using a rock bending model which takes into account spatial (2-dimensional) non-homogeneous distribution of proppant, fluid pressure distribution, and 2-dimensional fracture surface bending on proppant pillars. For example, the rock bending model may use the well-known Sneddon's formula $$\delta w = L_{unpropped}\sigma_h \frac{1-\nu^2}{E_r},$$

where $L_{unpropped}$ is the unpropped fracture length; $\sigma_h$ is the stress in the formation; $\nu$ is the Poisson's ratio of the rock formation; $E_r$ is Young's modulus of the rock formation and $\delta w$ is the fracture walls deflection. The fracturing model tool can solve when $\delta w$ would be greater than half the fracture width $w_f$ to model situations when opposing walls of the fracture would be touching one another at the near wellbore region and thus closing of the fracture and its disconnection from the wellbore (i.e. an unpropped zone). Results from the solved problem above generates $L_{unpropped}$ and, with the near wellbore fracture width $w_f$, an amount (unpropped fracture volume) of proppant that is needed to remedy the unpropped zone can be determined. A proppant placement schedule may then be used to reopen and reconnect these fractures with wellbore. A proppant placement schedule refers to a schedule for placing proppant in fractures that have been found to have unpropped zones and can include a pumping schedule and a fracture strategy. The pumping schedule is a plan prepared to specify such parameters as sequence, type, content and volume of fluid to be pumped during a fracturing or re-stimulation treatment. A fracture strategy is a plan to direct the flow of fluid at a certain pressure through certain fractures in a wellbore having unpropped zones and/or to inhibit flow through other fractures that do not have unpropped zones and can include the re-opening of an existing fracture which has lost connectivity with the wellbore due to an unpropped zone in order to enhance overall fracture conductivity and production. In some embodiments, the pumping schedule can include varying the type of proppant in the fluid, for example, the size or strength or coarseness of the proppant to be used in the re-stimulation treatment as compared to the proppant used in the initial fracture treatment.

Figure 4:
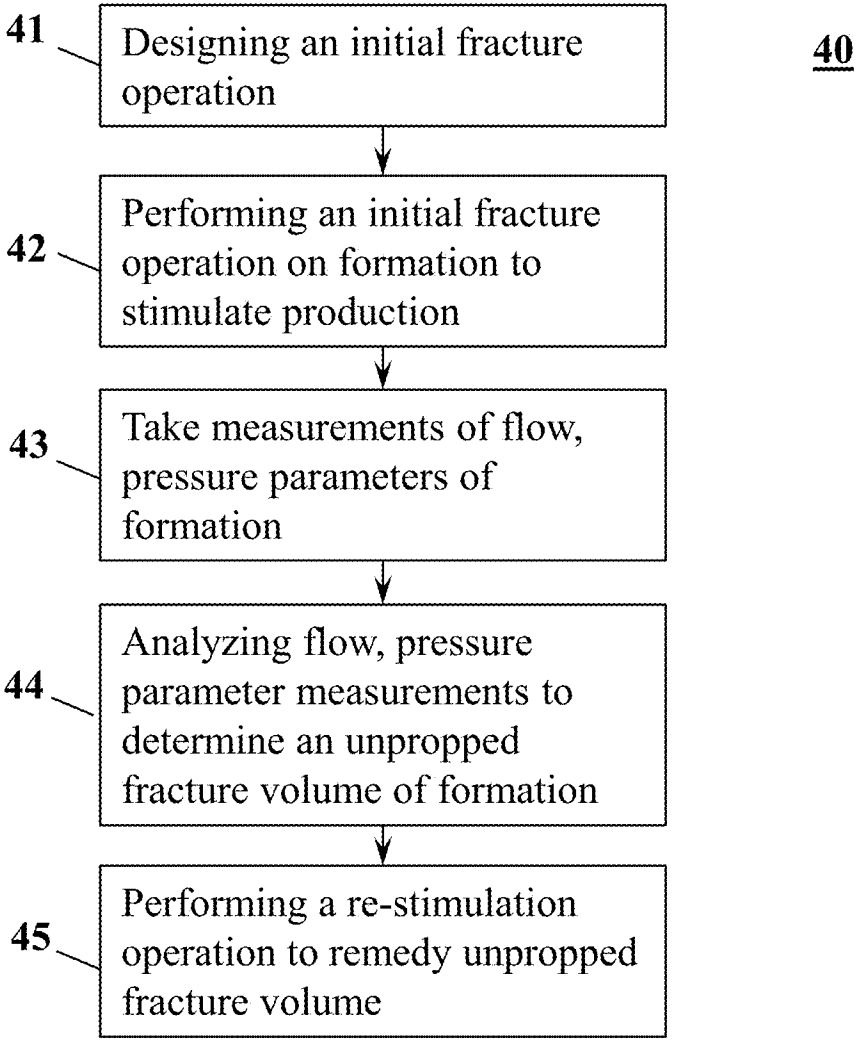
FIG. 4 is a block diagram of a method for stimulating a subterranean formation in accordance with one embodiment of the present disclosure.

Referring now to FIG. 4, a method 40 for stimulating and/or producing hydrocarbon fluids from a subterranean formation is illustrated. The method 40 generally includes designing an initial or first stimulation operation (i.e. fracture stimulation), performing the fracture stimulation on the subterranean formation to stimulate production, measuring wellbore parameters, such as fluid flow rate and pressure, analyzing the wellbore parameters to determine an unpropped fracture volume of the subterranean formation and performing a re-stimulation treatment to remedy the unpropped fracture volume. The method is performed by the processing and/or control unit 34 described above which is configured to transmit and receive data and design, control, monitor and/or analyze the stimulation and re-stimulation operations above. The method 40 includes one or more of the stages 41-45 described herein. In one embodiment, the method 40 includes execution of all of the stages 41-45 in the order described. However, certain stages 41-45 may be omitted, other stages may be added or the order of the stages may be changed.

In the first and second stages 41 and 42, an initial stimulation operation (i.e. fracture treatment) is designed and then performed on an area of the subterranean formation according to the design parameters to stimulate production from the subterranean formation. The designing of the first fracturing operation includes the amount of proppant and flowrate for proppant slurry transport at the pressure exceeding the fracturing pressure. The schedule of proppant slurry delivery may be steady one (creating a homogeneous proppant pack). The schedule of proppant slurry delivery may be a pulsed mode producing the heterogeneous proppant placement (technology known as channelled frac, HPP or HiWAY®).

For example, a new unproduced wellbore, such as an infill well drilled in a hydrocarbon field, is stimulated by disposing a stimulation device into the wellbore and injecting a fluid above a fracturing pressure using, for example the system 10, to open natural fractures and create new fractures in an area of the formation. A first proppant is then placed within such fractures during the fracture treatment to create propped fractures. The ending portion of the first proppant maybe a proppant with bigger size or higher strength (resistant to crash). This portion of high-quality proppant is known as "tail-in" proppant.

Measurements of various parameters are taken by sensors during the fracture operation and analyzed to estimate a near wellbore width $w_f$ of the fractures in the area. In some embodiments, the near wellbore width $w_f$ may be determined based on one or more measured or assumed properties of the fractures/formation or it can be directly measured using one or more tracers as described above. The pressure in the wellbore is lowered below the fracturing pressure used in the fracture operation to close the propped fractures and hydrocarbon fluids from the formation are produced.

In some instances, production over time may be less than predicted resulting in incomplete stimulation and suboptimal production, such as when fractures in the stimulated area close at their near wellbore region, for example by overflushing or proppant flow back. Accordingly, in stage 43 the fractured formation is monitored/measurements are taken by sensors and rate transient data is collected including at least one of pressure, pressure derivative, fluid flow rate, fluid flow rate derivative, proppant volume in the fluid and combinations thereof. During this stage, the formation may be monitored/measured at the end of the fracture operation and for a selected period of time after the fracture operation, for example, for at least several hours or days after fracturing has been completed. If the flow rate is below the target level, this might be caused by existence of unpropped zones in the generally propped fracture.

In stage 44, the rate transient data is analyzed to determine fractures in the stimulated area that are closed at their near wellbore region (i.e. unpropped zone) and therefore can be further stimulated and produced by placing a volume of proppant at the unpropped zone. Accordingly, the rate transient data is analyzed to determine the unpropped fracture length $L_{unpropped}$ at the unpropped zone, for example by using the rock bending model as described above. The unpropped fracture length $L_{unpropped}$ may then be used in combination with the near wellbore width $w_f$ to determine the volume of proppant (unpropped fracture volume) needed to remedy these unpropped zones.

In the fifth stage 45, a re-stimulation operation is performed to target to closed propped fractures (those having unpropped zones). For example, a second fluid containing the volume of second proppant determined at stage 44 is injected into the wellbore at a pressure at least equal to or above the fracturing pressure to reopen the closed fractures and to place the second proppant in such re-opened fractures. As described above, the second proppant may be the same proppant that was used in the initial fracture operation or it may be a different proppant, such as a coarser proppant. Filling of re-opened fracture with a portion of coarser proppant (refract) results in restoration of hydrocarbon production to at least the expected rate upon completion of the re-stimulation operation.

The systems and methods described herein provide various advantages over prior art techniques. Embodiments described herein provide an effective way to design and/or optimize production via re-stimulation to increase productivity. An improved and/or optimized re-stimulation operation can be designed and performed using pressure and fluid flow monitoring after an initial fracture operation and rock bending model, so that the re-stimulation operation can be used to effectively target fractures having unpropped zones at their near wellbore regions from which further production is feasible by re-opening such fractures and placing a certain volume of proppant in such unpropped zones and avoid unnecessary stimulation of fractures which do not have unpropped zones.

EXAMPLES

Example 1

In this example, a method in accordance with the present disclosure was applied to estimate and to refill an unpropped area (zone) at the near wellbore zone of fractures after an initial (first) fracturing stimulation which was followed by proppant displacement.

An initial hydraulic fracturing stimulation was performed in a reservoir having the following parameters: Young's modulus ($E_r$) of 26.9 GPa (3.9 Mpsi), and Poisson ratio ($\nu$) of 0.29. The stimulation parameters were: an injected slurry volume 54.5 $m^3$ (343 bbl) at a rate 2.0 $m^3$/min (12.5 bpm) carrying 19.5 tons of proppant with a concentration up to 960 kg/$m^3$ (8 PPA). The pad fluid fraction was 34%, and fluid efficiency was 50%. The stimulation used a gel with viscosity (μ) of 100 cP, the leakoff coefficient $(0.01778\ mm/min)^{0.5}$ and power-law behavior index for viscosity formula n=0.47. The proppant (20/40 mesh sand) had an average particle diameter ($d_r$) of 0.63 mm with relative density of solid particles 2.9.

For the given reservoir conditions and stimulation parameters, the final fracture had the following parameters: fracture height $H_f$=20 m, fracture length $L_f$=224 m, maximum propped fracture width at the near wellbore zone $w_f$=5.3 mm, and net pressure 3.9 MPa. These parameters were estimated via the Perkins-Kern-Nordgren (PKN) model (2D transport model for proppant slurry). Any other fracture model or a hydraulic fracturing simulator can be used to obtain the above parameters of propped fracture. The simulated results can be adjusted based on different techniques of fracturing pressure analysis (e.g. DataFrac®, injection tests, after closure analysis, flowback-rebound, etc.). For example, if the measured pressure during hydraulic fracturing execution was not matched with the net pressure 3.9 MPa, then model parameters recalibration should be performed until the pressure match.

Analysis of the actual pumped slurry volume showed that the proppant was over flushed (excessive amount of flush fluid pumped into the wellbore for displacing the proppant slurry deep into the open fracture) by flow rate $Q_{of}$ about 0.64 $m^3$ (4 bbl). Overflush of proppant created the unpropped zone at the near wellbore zone of the fractures having an unpropped length 5.8 m estimated by the following formula:

$$L_{unpropped} = \frac{Q_{of}}{H_f w_{nwb}}$$

The fracture walls bending (2δw) was then estimated using Sneddon's formula for mechanical bending:

$$2\delta w = 2L_{unpropped}\sigma_h \frac{1-\nu^2}{E_r}$$

where the stress on the proppant frac and fracture walls $\sigma_h$ was equal to 13.8 MPa and walls bending was calculated to be 5.6 mm. Any other similar approach or known formulas can be used to estimate the fracture walls bending and unpropped fracture length above.

Since the fracture walls bending (5.6 mm) was greater than the fracture width ($w_f$=5.3 mm), this indicates that the fracture was pinched at the near wellbore zone, and as a result, the propped fracture was disconnected from the wellbore.

To remedy this problem of the unpropped zone, a second hydraulic fracturing treatment (refrac treatment) was designed to reconnect the disconnected propped fractures and deliver the proper amount of a second proppant to the unpropped zone. The viscosity of the carrier fluid was increased up to 600 cP. The total volume of the second injected slurry was 0.5 $m^3$ (3 bbl) and it carried 0.172 ton of proppant having a 20/40 mesh at a pumping rate 0.08 $m^3$/min (0.5 bpm), and fluid efficiency ($\eta_p$) 48%. The total pumping time $T_p$ was 6.2 min, while the pad time $t_{PAD}$ was 2.1 min. Proppant concentration was increased in time from 0 up to 960 kg/$m^3$ (8 PPA) as a function:

$$c_{prop}(t) = 8PPA * \left(\frac{t - t_{PAD}}{T_p}\right)^{fp} \text{ where}$$

$$f_p = (1-\eta_p)/(1+\eta_p),\ f_p = (1-\eta_p)/(1+\eta_p).$$

As a result of completion of the second stimulation, a homogeneous proppant pack with a constant width $w_{f,2}$=1.8 mm and length 6.0 m was placed into the fracture. Since this new proppant pack length was greater than $L_{unpropped}$=5.8 m, we concluded that the un-propped zone (which appeared after the first treatment) was eliminated.

Because the new proppant pack thickness $w_{f,2}$=1.8 mm is 3 times less than initially planned $w_f$=5.3 mm, more permeable proppant is scheduled for pumping as the second treatment to restore the target conductivity of the near wellbore zone.

A job design with a higher amount of proppant can be pumped to increase the length and width of the proppant pack to further reduce risk of partial damage of the unpropped zone.

Example 2

One drawback of the second pumping schedule provided in Example 1 was the proppant pack thickness $w_{f2}$=1.8 mm (which is 3 times less than initially planned $w_f$=5.3 mm). A tip-screen-out (TSO) design was then proposed to create a proppant pack of 5.3 mm in the near wellbore zone. The viscosity of the carrying fluid was 600 cP. The total volume of injected slurry was increased up to 1.2 $m^3$ (7.7 bbl) and it carried 1,170 lb (proppant having a 20/40 mesh) at a pumping rate 0.08 $m^3$/min (0.5 bpm). Fluid efficiency ($\eta_{TSO}$) was 60%. The total pumping time $T_p$ was 15.4 min, and the pad portion time $t_{PAD}$ was 1 min. The proppant concentration was increased from 0 up to 960 kg/$m^3$ (8 PPA) as a function of time:

$$c_{prop}(t) = 8PPA * \left(\frac{t - t_{PAD}}{T_p}\right)^{fTSO}, \text{ where}$$

$$f_{TSO} = (1-\eta_{TSO})/(1+\eta_{TSO}),\ f_p = (1-\eta_p)/(1+\eta_p).$$

Because of second TSO treatment execution, the proppant pack of constant width $w_{f,TSO}$=5.3 mm and length 6.0 m was placed in the formation. The propped pack width is the same as the initially planned width, hence the same proppant as in the first treatment can be pumped. Thus, the propped pack length is greater than the unpropped length after the first treatment, and hence, the unpropped zone (which appeared after the first treatment) was completely filled by the proppant pack.

If the proppant with twice less permeability is only available, one can redesign this TSO job to obtain proppant pack 2 times wider than after the first treatment.

Example 3

In this example, a method in accordance with the present disclosure was applied to estimate and to eliminate an unpropped area (zone) at the near wellbore zone after proppant flowback.

The initial hydraulic fracturing stimulation was performed in the reservoir having the following parameters: Young's modulus ($E_r$) of 26.0 GPa (3 Mpsi), and the Poisson ratio (ν) of 0.25. Treatment parameters were the following: injected slurry volume 31.8 $m^3$ (200 bbl) at rate 1.6 $m^3$/min (10 bpm) that carried 4.6 ton of proppant with a concentration up to 360 kg/$m^3$ (3 PPA). Pad fraction was 37%. The stimulation used a gel with viscosity (μ) of 30 cP, providing the leakoff coefficient $(0.18\ mm/min)^{0.5}$ and power-law behavior index n=0.47. The proppant was 40/70 mesh sand and it had an average particle diameter ($d_p$) of 0.32 mm, while the ratio of particle to fluid density was 2.65.

For given above reservoir conditions and treatment parameters, the obtained fracture had parameters: height $H_f$=15.2 m, length $L_f$=231 m, maximum fracture width at near wellbore $w_f$=3.7 mm, and the fluid efficiency is 46%.

These parameters were estimated via the PKN fracture model. Any other fracture model or hydraulic fracturing simulator can be used to obtain the fracture geometry parameters above. The simulated results can be adjusted based on different techniques of fracturing pressure analysis (e.g., DataFrac®, injection tests, after closure analysis, flowback-rebound, etc.)

Based on the fracture width and height at the wellbore, the critical proppant flowback volume was estimated as:

$$V_{prop,crit}=L_{unpropped}*H_f*w_{nwb}$$

The unpropped length was estimated via Sneddon's formula:

$$L_{unpropped} = w_{nwb}\frac{1}{\sigma_h}\frac{E_r}{1-\nu^2},$$

where $\sigma_h$ is the stress on the proppant pack or the fracture walls. For the given above conditions and stress ($\sigma_h$) 3.8 MPa, the unpropped length was estimated to be 5.9 m, and the critical proppant flowback volume $V_{prop,\ crit}$=0.3 $m^3$ (2.1 bbl).

The measured proppant flowback volume was 0.4 $m^3$ (2.5 bbl). Because this value is above the critical proppant flowback volume, a second hydraulic treatment should be performed to remedy the fracture damage problem.

The flowback volume of 0.04 $m^3$ (0.25 bbl) corresponds to the observed unpropped length of 7.1 m. To eliminate the unpropped zone, a second hydraulic fracturing treatment was designed to deliver proppant to the unpropped zone. The viscosity of carrying fluid was increased up to 500 cP. The total injected slurry volume was 0.5 $m^3$ (3 bbl) and it carried 0.18 ton of 40/70 mesh proppant at pumping rate 0.08 $m^3$/min (0.5 bpm), and the fluid efficiency ($\eta_p$) was 54%. Total pumping time $T_p$ was 5.9 min, the pad time $t_{PAD}$ was 1.75 min. A higher carrier fluid viscosity allowed pumping the higher proppant concentration from 0 up to 960 kg/$m^3$ (8 PPA) as a function of time:

$$c_{prop}(t) = 8PPA*\left(\frac{t-t_{PAD}}{T_p}\right)^{fp} \text{ where}$$

$$f_p = (1-\eta_p)/(1+\eta_p),\ f_p = (1-\eta_p)/(1+\eta_p).$$

After the second treatment was completed, the proppant pack of a constant width $w_{f,2}$=1.8 mm and the length of 7.9 m was placed into the fracture. Since the proppant pack length was greater than $L_{unpropped}$=5.9 m, we concluded that the unpropped zone appeared after the first treatment was eliminated.

Since the proppant pack has the thickness $w_{f,2}$=1.8 mm which is 2 times less than initially planned $w_f$=3.7 mm, the twice more permeable proppant (with a bigger diameter) was assigned for pumping during the second treatment (refract operation) to restore conductivity of the near wellbore zone.

A design with more proppant can be pumped to increase length and width of proppant pack and to further reduce the risks of partial damage of the unpropped zone.

The particular embodiments disclosed above are illustrative only, as the present disclosure may be modified and practiced in different but equivalent manners apparent to one having ordinary skill in the art and having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The embodiments illustratively disclosed herein suitably may be practiced in the absence of any element that is not specifically disclosed herein and/or any optional element disclosed herein.

What is claimed is:

1. A method of stimulating a subterranean formation comprising:

(i) designing a first stimulation plan to create a propped fracture in the subterranean formation penetrated by a wellbore;

(ii) performing the first stimulation above a fracturing pressure to place a designed volume of a proppant of the first stimulation into a fracture;

(iii) closing the fracture of step (ii) by decreasing wellbore pressure and measuring wellbore parameters using a pressure sensor and a flowmeter;

(iv) determining a near wellbore width of the fracture of step (ii) based on data obtained from the measuring of the wellbore parameters of step (iii) and from evaluating performance of the first stimulation;

(v) determining an unpropped fracture length of the fracture of step (ii) at a near wellbore region based on a rock bending model;

(vi) determining an unpropped fracture volume at the near wellbore region based on the near wellbore width of the fracture and the unpropped length of the fracture; and (vii) performing a second stimulation configured to place a proppant of the second stimulation in the fracture in an amount equal to the unpropped fracture volume.

2. The method of claim 1, wherein the performance of the first stimulation is evaluated using a pressure decline analysis, a flowrate decline analysis, a simulation with a hydraulic fracturing simulator or a combination thereof.

3. The method of claim 1, wherein the determining of the unpropped fracture length of the fracture at the near wellbore region is based on one or more rock properties and the near wellbore width of the fracture.

4. The method of claim 1, wherein the proppant of the first stimulation and the proppant of the second stimulation are the same.

5. The method of claim 1, wherein the proppant of the second stimulation is different than the proppant of the first stimulation.

6. The method of claim 5, wherein the proppant of the second stimulation is coarser than the proppant of the first stimulation.

7. The method of claim 1, wherein the measuring wellbore parameters includes measuring wellbore parameters selected from first proppant concentration, pressure, pressure derivative, fluid flow rate, fluid flow rate derivative and a combination thereof.

8. The method of claim 1, wherein the second stimulation is performed at a pressure at least equal to the fracturing pressure.

9. A system for stimulating a subterranean formation comprising:

(i) a stimulation device configured to be disposed in a wellbore in the subterranean formation penetrated by a wellbore;

(ii) one or more sensors including a pressure sensor and a flowmeter positioned at a wellhead of the wellbore; and (iii) a processor operatively connected to the stimulation device and the one or more sensors and configured to perform;

a) a first stimulation configured to create a propped fracture in the subterranean formation;

b) a measurement of parameters in the wellbore by the pressure sensor and the flowmeter;

c) an analysis of the measurement and determination of a near wellbore width of the fracture, an unpropped fracture length at a near wellbore region, and an unpropped fracture volume at the near wellbore region; and d) a second stimulation configured to place a proppant of the second stimulation in the fracture in an amount equal to the unpropped fracture volume.

10. The system of claim 9, wherein the proppant of the first stimulation and the proppant of the second stimulation are the same.

11. The system of claim 9, wherein the proppant of the second stimulation is different from the proppant of the first stimulation.

12. The system of claim 9, wherein the measuring parameters are selected from first proppant concentration, pressure, pressure derivative, fluid flow rate, fluid flow rate derivative and a combination thereof.

* * * * *